US005380393A

United States Patent [19]

Drabarek et al.

[11] Patent Number: 5,380,393

[45] Date of Patent: Jan. 10, 1995

[54] HAND STRAPPING TOOL

[75] Inventors: Peter Drabarek, Chicago; Janusz Figiel, Mount Prospect, both of Ill.

[73] Assignee: Signode Corporation, Glenview, Ill.

[21] Appl. No.: 226,102

[22] Filed: Apr. 11, 1994

Related U.S. Application Data

[63] Continuation of Ser. No. 849,180, Mar. 10, 1992, abandoned.

[51] Int. Cl.[6] ..... B32B 35/00

[52] U.S. Cl. ..... 156/358; 156/502; 156/494; 100/33 PB

[58] Field of Search ..... 100/33 P; 156/502, 358, 156/494

[56] References Cited

U.S. PATENT DOCUMENTS

| | | | |
|---|---|---|---|
| 3,442,203 | 5/1969 | Kobiella | 100/26 |
| 3,586,572 | 6/1971 | Ericsson | 156/359 |
| 3,590,582 | 7/1971 | German et al. | 91/35 |
| 3,654,033 | 4/1972 | Anganola et al. | 100/30 |
| 3,674,972 | 10/1970 | Stahnke | 100/4 |
| 3,679,519 | 6/1970 | Frey | 156/359 |
| 4,305,774 | 12/1981 | Wedeking et al. | 156/494 |
| 4,450,032 | 5/1984 | Wehr | 156/502 |
| 4,629,530 | 12/1986 | Becking | 156/502 |
| 4,820,363 | 4/1989 | Fischer | 156/502 |
| 4,845,826 | 7/1989 | Daniels, Jr. | 29/252 |
| 5,169,480 | 12/1992 | Toppel | 156/502 |

*Primary Examiner*—W. Gary Jones
*Assistant Examiner*—Mark De Simone
*Attorney, Agent, or Firm*—Schwartz & Weinrieb

[57] ABSTRACT

A hand strapping tool for applying a strap to an article is provided wherein the hand strapping tool comprises a tensioning feedwheel assembly, a vibrating welding assembly, and a pneumatic circuit pneumatically connectable to a source of pressurized fluid for energizing the circuit. The circuit comprises a portion for automatically tensioning the strap around an article and a circuit portion for automatically welding the strap. The circuit also includes a portion for automatically determining tensioning of the strap around the article operatively associated with the circuit portion for automatically tensioning the strap. A circuit portion for automatically delaying welding of the strap is operatively connected to the circuit portion for automatically welding the strap. A circuit portion for automatically determining duration of welding of the strap is operatively associated with the circuit portion for automatically welding the strap. A circuit portion for automatically determining cool down time for a weld applied to the strap is operatively associated with the circuit portion for automatically welding the strap.

22 Claims, 4 Drawing Sheets

94
78
83
79
12
92
80
87
79
34
24
112
26
97
28
102A
108
40
98
114
110

HAND STRAPPING TOOL

This application is a continuation of application Ser. No. 07/849,180, filed Mar. 10, 1992 now abandoned.

FIELD OF THE INVENTION

The present invention generally relates to a unique construction of a tool for welding plastic strapping, and more specifically to a unique pneumatic control circuit for such a tool.

BACKGROUND OF THE INVENTION

Pneumatic control circuits have been utilized in a number of different employments. One such employment is a tool for applying a tensioned strap to an article. The general construction and operation of these strapping tools is evident, for example, from the following United States Patents:

| | | |
|---|---|---|
| Kobiella | 3,442,203 | 05/06/69 |
| Ericsson | 3,586,572 | 06/22/71 |
| Frey | 3,679,519 | 07/25/72 |
| Wedeking et al. | 4,305,774 | 12/15/81 |
| Becking | 4,629,530 | 12/16/86 |
| Cearlock et al. | 4,657,626 | 04/14/87 |

Generally, these tools apply a strap, usually supplied on a stock spool of sorts, around an outer periphery of an article, such as a box and the like. The strap, which can be of various constructions, such as high strength polyester, and the like, is tensioned around the article, and opposite ends of the strap are then welded or otherwise joined together to form a continuous loop around the article. By welding the opposite ends of the strap together, a clip need not be used to join the opposing ends of the strap to complete the loop, resulting in increased cost savings to the operator because such clips do not need to be purchased.

Particularly illustrative of these tools are the VFL and VFM TENSION-WELD TM strapping tools provided by the Signode Corporation. The VFL and VFM tools are illustrated and described in detail in the Signode Corporation's "Operation, Parts and Safety Manual" number 186096. These tools are provided with means for automatically tensioning the strap around the article.

However, with these tools, the operator is required to use his own judgment to determine appropriate temporal durations of the welding process for joining opposing ends of the strap, and of appropriate cool down times for insuring that the weld joining the opposite ends of the strap has sufficient structural integrity to remain tensioned around the article without rupturing. Because each operator's judgment is subjectively different, the tension and structural integrity of the straps can vary from article to article. The strap may not be properly tensioned or strong, possibly resulting in damage to the article. Accordingly, it is desirable to automatically and objectively determine the duration of the welding process.

Appropriate tools have been constructed which can automatically determine the duration of the welding process. The VXL-2000 and VXM-2000 TENSION-WELD TM strapping tools, illustrated and described in detail in the Signode Corporation's "Operation, Parts and Safety Manual" number 286102, are examples of tools having means for automatically determining duration of the welding process in the form of a time control circuit. The particular construction of this time control circuit is the subject of the co-pending U.S. patent application of Toppel, Ser. No. 07/476,873, filed on Feb. 8, 1990, now U.S. Pat. No. 5,169,480. That co-pending application is assigned to the assignee of the present invention, and the disclosure thereof is incorporated herein by reference.

The VXL-2000 and the VXM-2000, as well as the device and circuit disclosed in the above-referenced co-pending application, represent a second, improved generation embodiment of the VFL and the VFM TENSION-WELD TM strapping tools. However, both the original and second generation of those tools require an operator to use his judgment to determine the appropriate cool down time for the weld. If the weld applied between the opposing ends of the strap is not allowed to cool sufficiently, then the structural integrity of the resulting loop may be compromised by failure of the weld. This can result in damage to the article. Also, if the weld has not been properly cooled, the resulting loop may not be tensioned around the article as desired. Accordingly, it is desired to objectively and automatically determine the cool down time for insuring the structural integrity of the weld, as well as the resulting loop.

The present invention is intended to solve some, if not all, of the problems presented by the hand strapping tools of the prior art.

OBJECTS OF THE INVENTION

A general object of the present invention is to provide a unique construction for a hand strapping tool.

A more specific object of the invention is to provide a pneumatic control circuit having particular utility with controlling the operation of a hand strapping tool.

Another object of the present invention is to provide a unique tool having a pneumatic control circuit for controlling tensioning of a strap around an article, application of a weld to the strap, and cooling of the weld on a strap.

An additional object of the invention is to provide a unique tool having a pneumatic control circuit which allows the tool to operate fully automatically.

A further object of the present invention is to provide a hand strapping tool having a pneumatic control circuit which automatically determines and controls weld cool down time.

Yet another object of the invention is to provide a pneumatic control circuit for a tool which can minimize operator judgment of operation times of the tool.

SUMMARY OF THE INVENTION

A hand strapping tool, constructed according to the teachings of the present invention, for applying a strap to an article is provided, wherein the hand strapping tool comprises a pneumatic circuit, constructed according to the teachings of the present invention, pneumatically connectable to a source of pressurized fluid for energizing the circuit. A circuit portion for automatically tensioning the strap around an article and a circuit portion for automatically welding the strap is provided engagable with said strap. The circuit includes a portion for automatically determining tensioning of the strap around the article operatively associated with the circuit portion for automatically tensioning the strap. A circuit portion for automatically delaying welding of the strap is operatively connected to the circuit portion for automatically welding the strap. A circuit portion for automatically determining duration of welding of the strap is operatively associated with the circuit portion for automatically welding the strap. A circuit portion for automatically determining cool down time for a weld applied to the strap is operatively associated with the circuit portion for automatically welding the strap.

BRIEF DESCRIPTION OF THE DRAWINGS

The organization and manner of the structure and operation of the invention, together with further objects and advantages thereof, may best be understood by reference to the following description taken in connection with the accompanying drawings, wherein like reference numerals identify like elements throughout the several views in which.

DETAILED DESCRIPTION OF THE PREFERRED EMBODIMENT

Figure 1:
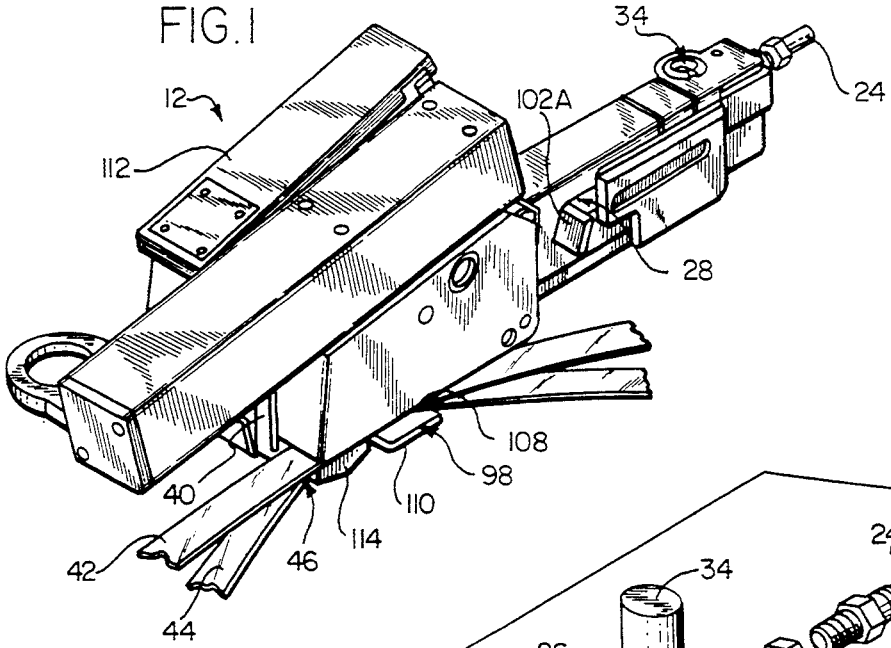
FIG. 1 is a perspective view of a hand strapping tool utilizing a pneumatic circuit, both constructed according to the teachings of the present invention.

While the invention may be susceptible to embodiment in different forms, there is shown in the drawings, and herein will be described in detail, a specific embodiment thereof with the understanding that the present disclosure is to be considered an exemplification of the principles of the invention, and is not intended to limit the invention to that as illustrated and described herein.

Figure 4:
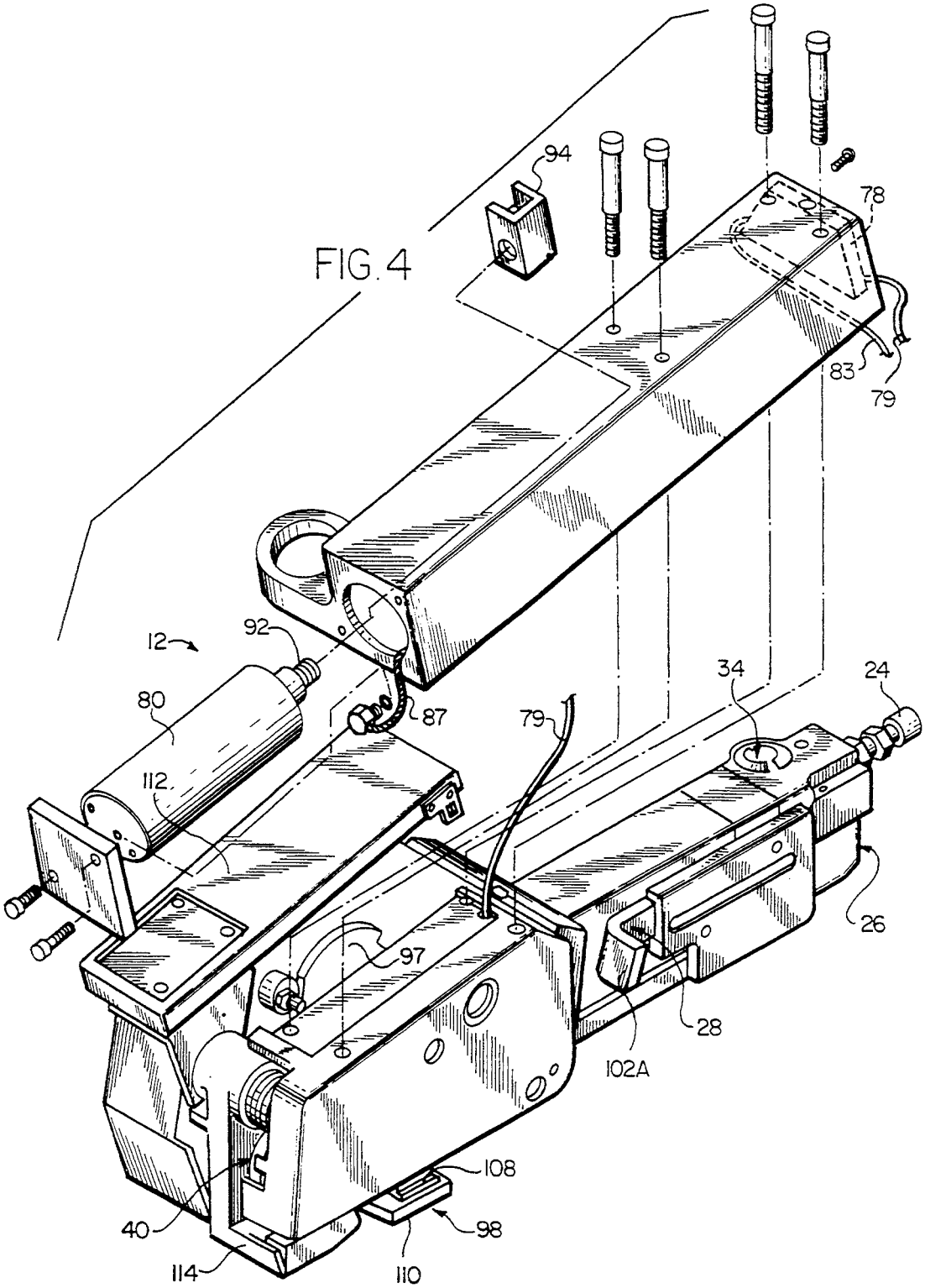
FIG. 4 is yet another exploded view of the hand strapping tool of FIG. 1 showing the construction of another portion of the pneumatic circuit.
Figure 5:
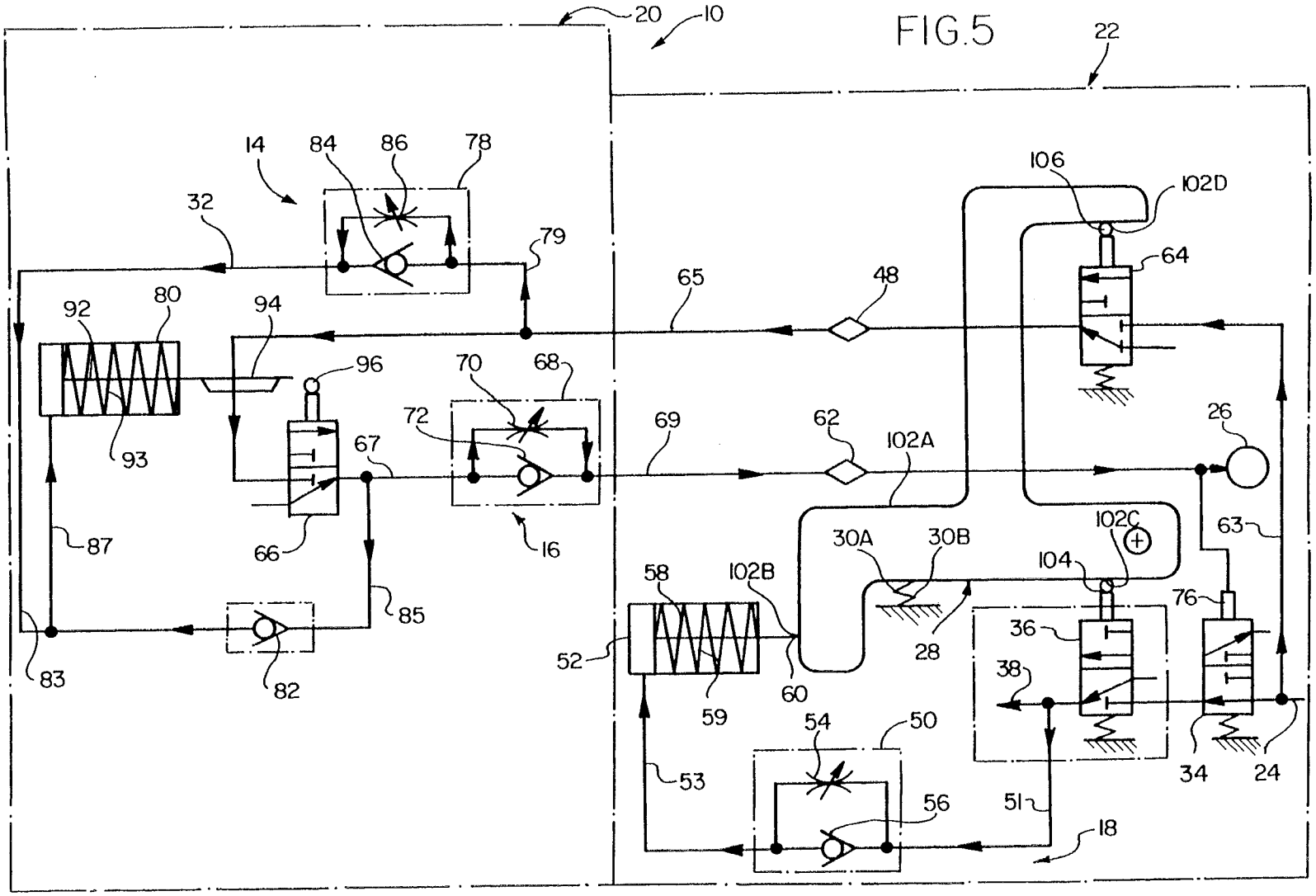
FIG. 5 is a schematic diagram of a preferred embodiment of the pneumatic circuit of the invention for controlling the operation of the hand strapping tool illustrated in FIG. 1.

Referring initially to FIG. 5, a pneumatic control circuit 10, constructed according to the teachings of the present invention, is illustrated schematically. It is to be noted that, while the circuit 10 will be discussed with respect to a specific employment with a hand strapping tool 12, illustrated in FIGS. 1 through 4, the circuit 10 can be effectively employed with a number of different tools and apparatus, such as the above-referenced VFL, VFM, VXL-2000, and VXM-2000 tools, for example. Accordingly, it is to be clearly understood that the scope of the present invention is not limited to any specific employments of the circuit 10.

Also, the general construction and operation of the tool 12 is disclosed fully in the above-designated Signode Corporation Manuals, as well as the above-referenced co-pending application. Accordingly, the construction of the tool 12 will be discussed in detail hereinbelow only as necessary to provide an understanding of the operation of the circuit 10. The construction and operation of the circuit 10 will be described first, with the relevant construction and operation of the tool 12 to follow.

The circuit 10 generally comprises means or a circuit portion 11 for automatically tensioning of a strap, means or a circuit portion 14 for delaying of welding of the strap until it is properly tensioned around an article, means or a circuit portion 16 for automatically determining duration of the welding process, and means or a circuit portion 18 for automatically determining cool down time of the weld. The circuit 10 is generally divided into a tension/weld module 20 and an air motor module 22, as shown in FIG. 5.

Because the circuit 10 is pneumatic, the circuit 10 has an inlet 24 operatively connectable to a compressed fluid source, not shown, for supplying air, and the like, at a predetermined line pressure. Accordingly, the inlet 24 is supplied with the line pressure for operating the circuit 10 and the tool 12. While the invention will be discussed with respect to an employment thereof with compressed or driven air, it is to be understood that the circuit 10 can effectively utilize other types of driven or compressed fluids.

Figure 2:
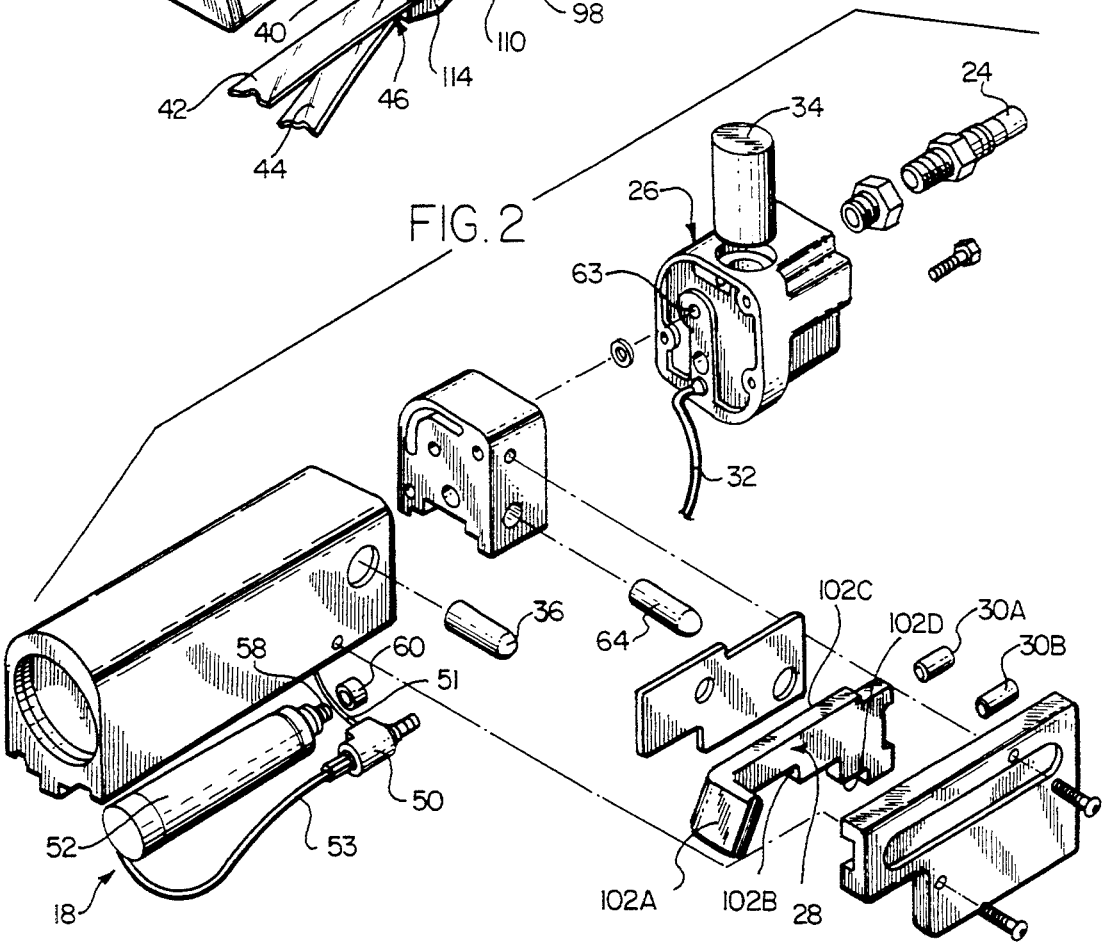
FIG. 2 is an exploded perspective view of a rear portion of the hand strapping tool of FIG. 1, illustrating the particular construction of a portion of the pneumatic circuit of the invention.

The circuit 10 includes a plurality of flow control valves, a plurality of pneumatic cylinders, a plurality of fluid filters, a volume chamber 26, and a spring-biased mechanical lever 28 which can manually shift with springs 30A and 30B, shown in FIG. 2, between a tool-on position and a tool-off position. The springs 30A and 30B bias the lever 28 towards the tool-off position. The valves, filters, cylinders, and the chamber 26 are pneumatically connected by circuitous conduits 32, where necessary, as will be described in detail in the following paragraphs.

Specifically, as shown in FIGS. 2 and 5, a first valve 34, which includes a pilot valve, is pneumatically connected to the source of compressed air through the inlet 24. A second valve 36 is connected pneumatically in series with the first valve 34 such that the first valve 34 is pneumatically located between the second valve 36 and the inlet 24. The first and the second valves 34 and 36, respectively, are of the well known three way type, that is, they have an open, a closed, and an exhaust position. The second valve 36 is, in turn, connected to an outlet 38 for directing forced or compressed air against a drive rotor of an air motor for energizing the air motor.

Figure 3:
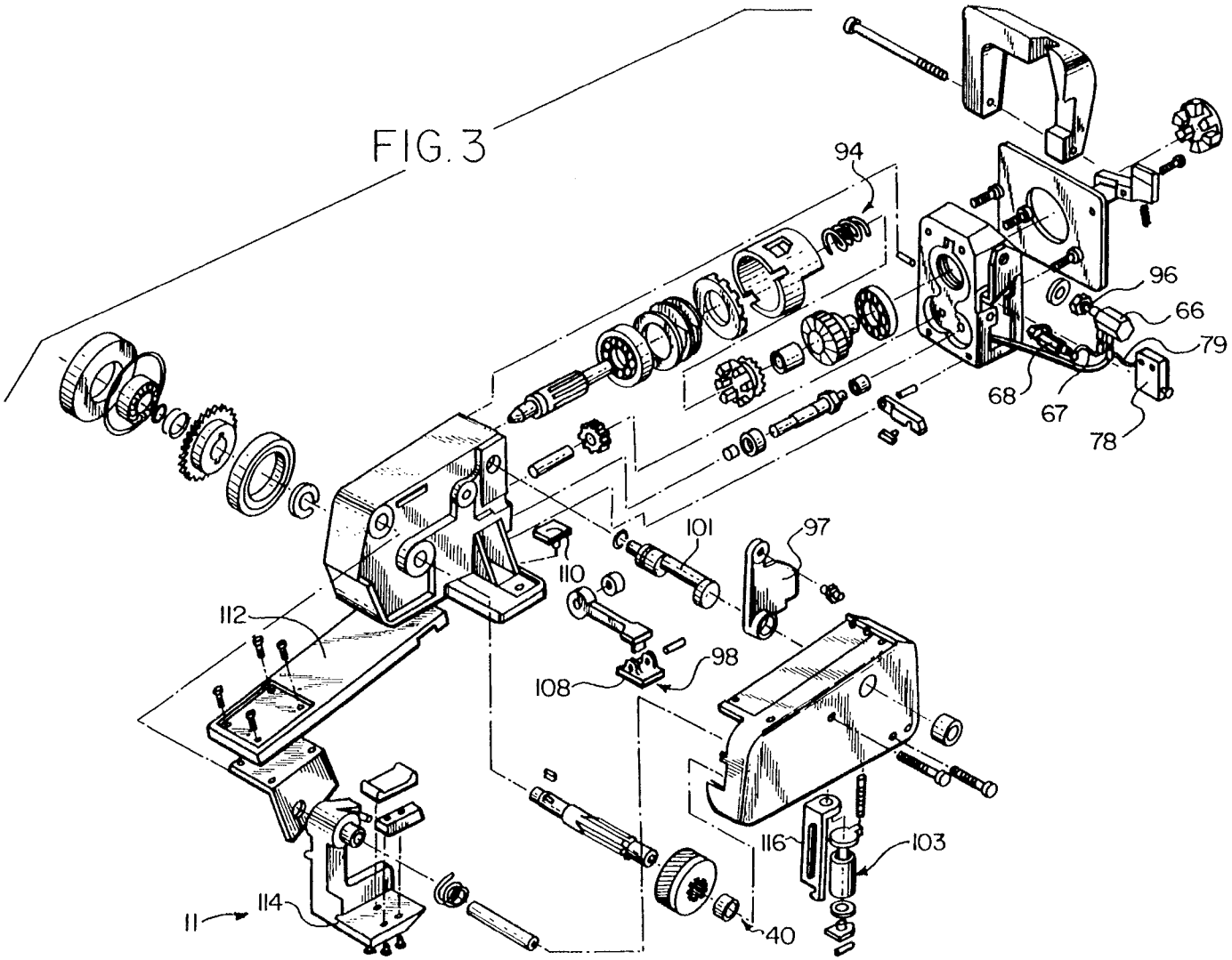
FIG. 3 is an exploded view of a frontal portion of the hand strapping tool of FIG. 1, illustrating the construction of another portion of the pneumatic circuit as well as the construction of the tensioning means and the welding means.

As disclosed in the above-referenced Manuals and co-pending application, the air motor is utilized to tension a strap 46 around an article, not shown. As illustrated in FIGS. 1, 3 and 4, the air motor activates a feedwheel tensioning assembly 40 for gripping and tensioning opposing ends 42 and 44 of a strap 46 around the article. The air motor is constructed so that, once the strap 46 has been tensioned around the article to the desired degree, the air motor stalls, thereby automatically determining the appropriate tensioning of the strap 46. This aspect of the tool 12 is well known in the relevant art, and is disclosed in the above-cited Manuals. The air motor also drives a welding mechanism for welding together of the ends 42 and 44 of the strap 46.

Again drawing attention to FIGS. 2 and 5, a first flow control valve 50 is pneumatically connected between the second valve 36 and the outlet 38 by an appropriate channel or piece of conduit 51. The valve 50 is connected in parallel with the pneumatic motor 37 and the outlet 38, illustrated schematically in FIG. 5. The valve 50 is, in turn, connected pneumatically in series by a pneumatic line or conduit 53 to a first pneumatic actuator or cylinder 52, as shown in FIGS. 2 and 5.

The flow control valve 50 comprises a variable orifice 54 and a check valve 56. The orifice 54 is connected pneumatically in parallel across the check valve 56. The variable orifice 54 allows an operator to predetermine the amount of time required to vent compressed air from the cylinder 52. The check valve 56 permits free flow of compressed air to the cylinder 52 and prevents the flow of compressed air from the cylinder 52 towards the valve 36. Accordingly, venting of the cylinder 52 must occur through the variable orifice 54. The controlled venting of the cylinder 52 by the valve 50, as will be discussed in further detail hereinbelow, determines the cool down time. Thus, the cylinder 52 and the valve 50 comprise the means or circuit portion 18.

The cylinder 52 comprises a spring-biased piston 58 which shifts, under the influence of a spring 59 to a retracted position, and, under the influence of compressed air supplied through the valve 50, to an extended position. The piston 58 includes a contacting portion or rod 60 for maintaining the lever 28 in a depressed condition when the piston 58 is in the extended position. The functionality of these elements will become more clear hereinafter.

A third valve 64 is connected pneumatically in parallel with the first valve 34 between the inlet 24 and the first valve 34 by pneumatic line 63. The third valve 64 is also of the well known three way type. The third valve 64 is connected pneumatically in series, by an appropriate piece of conduit 65, to a fourth valve 66, also of the three way type, as shown in FIG. 5. A first filter 48, of known construction, is pneumatically connected in series between the third valve 64 and the fourth valve 66.

An outlet part of the fourth valve 66 is pneumatically connected in series by line 67 to a second flow control valve 68, shown in FIGS. 3 and 5. The valve 68 is substantially similar to the valve 50 in that the valve 68 comprises a variable orifice 70 and a check valve 72, with the orifice 70 being pneumatically connected in parallel across the check valve 72. The valve 68 is pneumatically connected in series by line 69 to a volume chamber 26. The check valve 72 prevents air flow from the valve 66 to the chamber 26 so that air directed towards the chamber 26 must flow through the variable orifice 70. Accordingly, the valve 68 controls the filling time of the chamber 26, and comprises the means or circuit portion 16 for determining the weld time, as will be discussed further hereinbelow.

A second filter 62, illustrated schematically in FIG. 5, and substantially similar in construction to the filter 48, is pneumatically connected in series between the valve 68 and the volume chamber 26. A pressure operable actuator 76 included in the first valve 34 is connected pneumatically in parallel with the volume chamber 26, as shown in FIG. 5. The actuator 76 causes the valve 34 to react to pressures contained within the volume chamber 26. The significance of this will also become more clear later.

Another branch of the circuit 10 is pneumatically connected in parallel across the fourth valve 66. This branch comprises a third flow control valve 78, visible in FIGS. 3 through 5, a second pneumatic actuator or cylinder 80, shown in FIGS. 4 and 5, and a check valve 82. The valve 78 is connected at one end to the line 65 by a branch line 79 between the third valve 64 and the fourth valve 66, as illustrated in FIG. 5. The opposite end of the valve 78 is connected to one end of the check valve 82 by branch line 83, with the opposite end of the check valve 82 being connected to the conduit 67 by branch line 85 between the valve 66 and the valve 68. The valve 78 is constructed substantially similar to the valves 50 and 68 in that the valve 78 comprises a check valve 84 and a variable orifice 86 with the orifice 86 being pneumatically connected in parallel across the check valve 84. The check valve 84 prevents air flow from the valve 64 into the second cylinder 80 which is connected to the line 83 by branch line 87. Therefore, the air directed towards the cylinder 80 must flow through the variable orifice 86. In this manner, the valve 78 comprises the means or circuit portion 14, the functionality of which will be discussed in detail hereinafter.

The cylinder 80, shown in FIGS. 4 and 5, is connected pneumatically in parallel between the valve 78 and the valve 82. The cylinder 80 comprises a piston 92 biased to a retracted position by spring 93 and shiftable in response to compressed air from the retracted position, to a partially extended position, and a fully extended position. The piston 92 is connected to an actuator member 94, shown fully in FIG. 4, which shifts a pivoting member or cam 97, shown in FIG. 3, for compressing a mechanical actuator 96 associated with the valve 66 when the piston 92 is in the partially extended position. When the cam member 97 depresses the mechanical actuator 96, the valve 66 is opened and allows pressure to build up in the chamber 26.

Simultaneously, compressed air is allowed to flow through the valve 82 and into the cylinder 80. This encourages the actuator member 94 to shift into the fully extended position after the air motor is disconnected mechanically from the tensioning assembly 40 (the air motor is stalling at this point due to desired tensioning being present on the strap 46) by a well known clutch mechanism 99, shown in FIG. 3 and discussed in the above referenced Manuals.

Meanwhile, the actuator member 94 pivots the member 97 as well as an eccentric shaft 101 attached to the member 97. The eccentric shaft 101 causes a vibrating welding assembly 98, well known in the art and illustrated in FIGS. 1, 3 and 4, to operatively engage the opposite ends 42 and 44 of the strap 46 so that the welding process can begin. Specifically, a vibrating welding plate 108 is lowered on top of a fixed welding plate 110 so that the opposite ends 42 and 44 of the strap 46 are vibratingly compressed therebetween.

The lever 28 has at least four contact areas 102A, 102B, 102C, and 102D, illustrated in FIGS. 2 and 5. The contact area 102A, shown in FIGS. 1, 2, 4 and 5, is intended to be contacted by an operator's finger for manually shifting the lever into the tool-on position. The contact area 102B is positioned to be contacted by the contacting portion 60 of the spring-biased piston 58 of the cylinder 52. In this manner, the lever 28 can be held in the tool-on position by the piston 58.

The contact area 102C is positioned to operatively contact an actuator 104, shown schematically in FIG. 5, operatively associated with the valve 36 when the lever 28 is in the tool-on position. Accordingly, when the lever 28 is in the tool-on position, the actuator 104 will shift the valve 36 into the open position, thereby causing air to flow into the cylinder 52 for maintaining the lever 28 in the tool-on position, as well as causing compressed air to drive the air motor. The contact area 102D is positioned to operatively contact an actuator 106, substantially similar to the actuator 104, operatively associated with the valve 64 for shifting the valve 64 into the open position. When the valve 64 is so shifted, air will flow into the cylinder 80.

With the construction of the circuit 10 being thusly disclosed, the operation thereof, as well as the functionality of the relevant elements of the tool 12, will now be discussed in detail. It is to be noted that further structural requirements of the circuit 10, and/or the tool 12, may become more apparent with reference to the following discussion, as well as to the above-cited Manuals and co-pending application.

An operator begins by connecting the circuit 10, and thereby the tool 12, to a source of compressed air, or the like. Because valve 36 and valve 64 are normally closed, air flows through valve 34 and stops at valve 36, while air flows to and stops at valve 64. This is the tool-off condition of the circuit 10, which corresponds to an "at rest" condition of the tool 12. Of course, the lever 28 is in the tool-off position.

At this point, the operator places the opposite ends 42 and 44 of the strap 46 through the feed wheel tensioning assembly 40 and the welding assembly 98 in an appropriate fashion, as shown in FIG. 1. The operator then manually actuates a lever 112, shown in FIGS. 1, 3, and 4, which rotates an associated foot assembly 114 into a proper position for tensioning the strap 46. This procedure is well known in the relevant art, and is described in the above-referenced Manuals. The operator then manually depresses the lever 28 by pressing on the contact area 102A. This shifts the lever 28 into the tool-on position, and the cycle of the circuit 10 and the tool 12 begins.

Shifting of the lever 28 into the tool-on position brings the contact area 102C into operative contact with the actuator 104 on valve 36, thereby opening it. Air flows through valve 34 and valve 36, and through the outlet 38 for causing the air motor to energize for operating the assembly 40 to tension the strap 46 around the article. The tensioning assembly 40 operates in well known fashion, as disclosed in the above-referenced Manuals.

Air also flows through the valve 50 into the cylinder 52. The air flowing into the cylinder 52 causes the piston 58 to shift into the extended position, thereby bringing the contacting portion 60 into bearing contact with the contact portion 102B of the lever 28. In this manner, the lever 28 is held in the tool-on position, and the operator no longer has to apply a force to the contact area 102A of the lever 28.

Simultaneously, the contact area 102D operatively engages the actuator 106 on the valve 64, thereby shifting the valve 64 into the open position. Air flows through valve 64, filter 48 and valve 78 into the cylinder 80, as disclosed hereinabove. Air pressure builds up in the cylinder 80 slowly, as determined by the variable orifice 86, thereby causing correspondingly slow shifting of the piston 92 into the partially extended position. The pivoting cam member 97 also pivots in response to shifting of the piston 92 and the actuator member 94. The speed by which air pressure builds up in the cylinder 80 is predetermined such that the air motor will apply desired tension to the strap 46 before the cam member 97 operatively contacts the mechanical activator 96 of valve 66. The strap 46 is appropriately tensioned around the article before the welding process begins. Once the strap 46 is properly tensioned, the air motor stalls, as disclosed in the Manuals.

When the valve 66 is opened, air flows through valve 68 and filter 62 at a rate predetermined by the variable orifice 70, and into the chamber 26. Simultaneously, air flows through check valve 82 into the cylinder 80, causing the piston 92 to shift into the fully extended position. The clutch mechanism 99 mechanically disconnects the motor from the tensioning assembly 40. The member 97 rotates the eccentric shaft 101 which shifts assembly 103 for pressing the vibrating welding plate 108 into operative contact with the ends 42 and 44 of the strap 46 (in the tools of the prior art, this step had to be performed manually). The air motor is free to operate again, and begins to weld the ends 42 and 44 of the strap 46 together, thereby forming a continuous loop around the article.

Air continues to flow through the filter 62 and into the chamber 26 until sufficient pressure is built up therein. When this occurs, the pressure, operable actuator 76 causes the pilot valve to close the valve 34. Accordingly, no air flows to valve 36. The air motor stops, and the welding process ends. However, the welded opposite ends 42 and 44 of the strap 46 are held automatically between the weld plates 108 and 110 under pressure for a time period sufficient to insure appropriate cooling of the weld.

Valve 34 allows air to vent slowly from the cylinder 52 at a rate determined by the variable orifice 54 of the valve 50. The speed of this venting is predetermined, and represents the weld cool down time. After the cool down time period has elapsed, pressure in the cylinder 52 drops sufficiently so that the spring-loaded piston 58 shifts into the retracted position. Accordingly, the lever 28 is mechanically returned to the tool-off position by the springs 30A and 30B. Actuators 104 and 106 are released, and the valves 36 and 64 are allowed to return to their closed positions.

The cylinder 80 is vented through valves 64 and 78 so that the piston 92 returns towards the retracted position. As the piston 92 leaves the fully extended position, the eccentric shaft 101 is rotated back towards its original, tool-off position. As the shaft 101 approaches the tool-off position, the vibrating weld plate 108 is moved upwardly away from the fixed weld plate 110 by link 116. The lever 112 also returns to its tool-off position. The weld is now sufficiently cooled to insure the structural integrity thereof, and welded strap can now be removed from the tool.

As the piston 92 returns to the retracted position, the engaging contact between the cam member 97 and the mechanical activator 96 operatively associated with the valve 66 is broken. Accordingly, the valve 66 returns to its original, closed position, so that the volume chamber 26 is now vented through valves 68 and 66 to the surrounding atmosphere such that the pressure built up in the chamber 26 falls. The pressure operable actuator 76 operatively associated with the valve 34 senses this pressure drop in the chamber 26, and when that pressure has dropped to a predetermined level, the valve 34 is reset to its original, open position. At this point, the circuit 10 and the tool 12 are ready to execute another cycle in the above-disclosed fashion.

While a preferred embodiment of the present invention is shown and described, it is envisioned that those skilled in the art may devise various modifications of the present invention without departing from the spirit and scope of the appended claims. The invention is not intended to be limited by the foregoing disclosure, but only by the following appended claims.

The invention claimed is:

1. A strapping tool for applying a strap to an article, comprising:

a pneumatic circuit pneumatically connectable to a source of pressurized fluid for energizing said circuit;

means for automatically tensioning a strap around an article;

means engageable with said strap for automatically welding said strap;

means, operatively associated with said means for automatically tensioning said strap, for automatically determining tensioning of said strap around said article, whereupon determination of a proper degree of tension within said strap disposed around said article, operation of said tensioning means is terminated;

manually operable means movable between a first position at which said means for welding said strap are automatically caused to be disengaged from said strap, and a second position at which said means for welding said strap are automatically caused to be engaged with said strap;

first pneumatic control means, operatively associated with said tensioning means, for automatically delaying welding of said strap until said proper degree of tension within said strap has been accomplished, and for subsequently actuating said welding means for welding said strap;

second pneumatic control means, operatively associated with said means for automatically welding said strap, for automatically determining the duration of said welding of said strap so as to therefore define a welding cycle; and third pneumatic control means, operatively associated with said manually operable means, for automatically maintaining said manually operable means at said second position for in turn maintaining said welding means engaged with said strap, after deactuation of said welding means upon completion of said welding cycle, for a predetermined period of time so as to therefore determine a cool down period of time for a weld developed within said strap and thereby insure proper weld integrity, and for automatically releasing said manually operable means for return to said first position at which said means for welding said strap are disengaged from said strap.

2. A strapping tool as defined in claim 1 wherein the means for automatically delaying welding of the strap comprises a first flow control valve and a first pneumatic actuator responsive to fluid flow through the first flow control valve; the first flow control valve regulating fluid flow therethrough into the first pneumatic actuator; and the means for automatically welding the strap being operatively connected to the first pneumatic actuator such that the means for automatically welding the strap is shifted into operative engagement with the strap in response to movement of the first pneumatic actuator.

3. A strapping tool as defined in claim 2 wherein the means for automatically determining cool down time comprises a second flow control valve and a second pneumatic actuator responsive to fluid flow through the second flow control valve; the second flow control valve regulating fluid flow from the second pneumatic actuator; a first valve pneumatically connected with the first flow control valve for permitting fluid flow to and from the first flow control valve and the first pneumatic actuator; and the second pneumatic actuator being operatively associated with the first valve for permitting fluid flow to and from the first flow control valve and the first pneumatic actuator in response to movement of the second pneumatic actuator.

4. A strapping tool as defined in claim 3 wherein the means for automatically determining duration of welding of the strap comprises a second valve, a third flow control valve, and a volume chamber for accepting a pressure pneumatically connected in series; the second valve being pneumatically connected to the first valve for permitting fluid flow to and from the third flow control valve and the volume chamber; the third flow control valve being pneumatically connected between the second valve and the volume chamber; the third flow control valve regulating fluid flow into the volume chamber; a third valve for preventing pressurized fluid from energizing the circuit; and the third valve having a pressure operable actuator operatively connected to the volume chamber for actuating the third valve to prevent pressurized fluid from energizing the circuit responsive to pressure in the volume chamber.

5. A strapping tool as defined in claim 1 wherein the means for automatically determining cool down time comprises a flow control valve and a pneumatic actuator responsive to fluid flow through the flow control valve; the flow control valve regulating fluid flow from the pneumatic actuator; and the means for automatically welding the strap being operatively associated with the pneumatic actuator such that the means for automatically welding the strap is shifted out of operative engagement with the strap in response to movement of the pneumatic actuator.

6. A strapping tool as defined in claim 1 wherein the means for automatically determining duration of welding of the strap comprises a first valve, a flow control valve, and a volume chamber for accepting a pressure pneumatically connected in series; the first valve permitting fluid flow to and from the flow control valve and tile volume chamber; the flow control valve being pneumatically connected between the first valve and the volume chamber; the flow control valve regulating fluid flow into the volume chamber; a second valve for preventing pressurized fluid from energizing the circuit; and the second valve having a pressure operable actuator operatively connected to the volume chamber for actuating the second valve to prevent pressurized fluid from energizing the circuit responsive to pressure in the volume chamber.

7. A strapping tool having means for tensioning a strap, and means for welding overlapping portion of said strap, comprising:

a pneumatic circuit pneumatically connectable to a source of pressurized fluid for energizing said pneumatic circuit;

said pneumatic circuit including a first circuit portion for actuating said tensioning means for automatically tensioning a strap around an article;

a second circuit portion for actuating said welding means for automatically welding said strap;

a third circuit portion, operatively associated with said first circuit portion, for automatically determining tensioning of said strap around said article, whereupon determination of a proper degree of tension within said strap disposed around said article, operation of said tensioning means is terminated;

manually operable means movable between a first position at which said means for welding said strap are automatically caused to be disengaged from said strap, and a second position at which said means for welding said strap are automatically caused to be engaged with said strap;

a fourth circuit portion, operatively connected to said second circuit portion, for automatically delaying welding of said strap until desired tensioning of said strap has been achieved, and for subsequently permitting said second circuit portion to automatically actuate said welding means for welding said strap;

a fifth circuit portion, operatively associated with said second circuit portion, for automatically determining the duration of said welding of said strap so as to therefore define a welding cycle; and a sixth circuit portion, operatively associated with said manually operable means, for automatically maintaining said manually operable means at said second position for in turn maintaining said welding means engaged with said strap, after deactuation of said welding means upon completion of said welding cycle, for a predetermined period of time so as to therefore determine a cool down period of time for a weld developed within said strap and thereby insure proper weld integrity, and for automatically releasing said manually operable means for return to said first position at which said means for welding said strap are disengaged from said strap.

8. A strapping tool as defined in claim 7 wherein the fourth circuit portion comprises a first flow control valve and a first pneumatic actuator responsive to fluid flow through the first flow control valve; the first flow control valve regulating fluid flow therethrough into the first pneumatic actuator; and the second circuit portion being operatively connected to the first pneumatic actuator such that the welding means is shifted into operative engagement with the strap in response to movement of the first pneumatic actuator.

9. A strapping tool as defined in claim 8 wherein the sixth circuit portion comprises a second flow control valve and a second pneumatic actuator responsive to fluid flow through the second flow control valve; the second flow control valve regulating fluid flow from the second pneumatic actuator; a first valve pneumatically connected with the first flow control valve for permitting fluid flow to and from the first flow control valve and the first pneumatic actuator; and the second pneumatic actuator being operatively associated with the first valve for permitting fluid flow to and from the first flow control valve and the first pneumatic actuator in response to movement of the second pneumatic actuator.

10. A strapping tool as defined in claim 8 wherein the fifth circuit portion comprises a second valve, a third flow control valve, and a volume chamber for accepting a pressure pneumatically connected in series; the second valve being pneumatically connected to the first valve for permitting fluid flow to and from the third flow control valve and the volume chamber; the third flow control valve being pneumatically connected between the second valve and the volume chamber; the third flow control valve regulating fluid flow into the volume chamber; a third valve for preventing pressurized fluid from energizing the circuit; and the third valve having a pressure operable actuator operatively connected to the volume chamber for actuating the third valve to prevent pressurized fluid from energizing the circuit responsive to pressure in the volume chamber.

11. A strapping tool as defined in claim 7 wherein the sixth circuit portion comprises a flow control valve and a pneumatic actuator responsive to fluid flow through the flow control valve; the flow control valve regulating fluid flow from the pneumatic actuator; and the second circuit portion being operatively associated with the pneumatic actuator such that the welding means is shifted out of operative engagement with the strap in response to movement of the pneumatic actuator.

12. A strapping tool as defined in claim 7 wherein the fifth circuit portion comprises a first valve, a flow control valve, and a volume chamber for accepting a pressure pneumatically connected fen series; the first valve permitting fluid flow to and from the flow control valve and the volume chamber; the flow control valve being pneumatically connected between the first valve and the volume chamber; the flow control valve regulating fluid flow into the volume chamber; a second valve for preventing pressurized fluid from energizing the circuit; and the second valve having a pressure operable actuator operatively connected to the volume chamber for actuating the second valve to prevent pressurized fluid from energizing the circuit responsive to pressure in the volume chamber.

13. A tool as set forth in claim 2, wherein:

said first flow control valve comprises a variable orifice and a check valve disposed in parallel with respect to each other; and said first pneumatic actuator comprises a spring-biased piston-cylinder assembly.

14. A tool as set forth in claim 3, wherein:

said second flow control valve comprises a variable orifice and a check valve disposed in parallel with respect to each other;

said second pneumatic actuator comprises a spring-biased piston-cylinder assembly; and said first valve comprises a normally-closed, three-position valve.

15. A tool as set forth in claim 4, wherein:

said second valve comprises a normally-closed three-position valve;

said third flow control valve comprises a variable orifice and a check valve disposed in parallel with respect to each other; and said third valve comprises a normally-open three-position valve.

16. A tool as set forth in claim 5, wherein:

said flow control valve comprises a variable orifice and a check valve disposed in parallel with respect to each other; and said pneumatic actuator comprises a spring-biased piston-cylinder assembly.

17. A tool as set forth in claim 6, wherein:

said first valve comprises a normally-closed three-position valve;

said flow control valve comprises a variable orifice and a check valve disposed in parallel with respect to each other; and said second valve comprises a normally-open three-position valve.

18. A tool as set forth in claim 8, wherein:

said first flow control valve comprises a variable orifice and a check valve disposed in parallel with respect to each other; and said first pneumatic actuator comprises a spring-biased piston-cylinder assembly.

19. A tool as set forth in claim 9, wherein:

said second flow control valve comprises a variable orifice and a check valve disposed in parallel with respect to each other;

said second pneumatic actuator comprises a spring-biased piston-cylinder assembly; and said first valve comprises a normally-closed three-position valve.

20. A tool as set forth in claim 10, wherein:

said second valve comprises a normally-closed, three-position valve;

said third flow control valve comprises a variable orifice and a check valve disposed in parallel with respect to each other; and said third valve comprises a normally-open, three-position valve.

21. A tool as set forth in claim 11, wherein:

said flow control valve comprises a variable orifice and a check valve disposed in parallel with respect to each other; and said pneumatic actuator comprises a spring-biased, piston-cylinder assembly.

22. A tool as set forth in claim 12, wherein:

said first valve comprises a normally-closed, three-position valve;

said flow control valve comprises a variable orifice and a check valve disposed in parallel with respect to each other; and said second valve comprises a normally-open, three-position valve.

* * * * *